US008354607B2

(12) United States Patent
Sato et al.

(10) Patent No.: US 8,354,607 B2
(45) Date of Patent: Jan. 15, 2013

(54) SWITCHGEAR HAVING MAIN CIRCUIT SWITCHES DISPOSED IN SEPARATE VACUUM CHAMBERS

(75) Inventors: Takashi Sato, Mito (JP); Kenji Tsuchiya, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 448 days.

(21) Appl. No.: 12/025,966

(22) Filed: Feb. 5, 2008

(65) Prior Publication Data

US 2008/0190895 A1 Aug. 14, 2008

(30) Foreign Application Priority Data

Feb. 14, 2007 (JP) ..... 2007-033006

(51) Int. Cl.
*H01H 33/666* (2006.01)

(52) U.S. Cl. ..... 218/120; 218/7; 218/10

(58) Field of Classification Search ..... 218/118–120, 218/2–14, 43–47, 140, 152–154
See application file for complete search history.

(56) References Cited

U.S. PATENT DOCUMENTS 4,306,128 A * 12/1981 Innami et al. ..... 218/141
7,135,652 B2 * 11/2006 Kobayashi et al. ..... 218/155

FOREIGN PATENT DOCUMENTS

| | | |
|---|---|---|
| EP | 1 693 873 | 8/2006 |
| JP | 2000-306474 | 11/2000 |
| JP | 2001-126595 | 5/2001 |
| JP | 2001-135207 | 5/2001 |
| JP | 2002152930 | 5/2002 |
| JP | 2004056957 | 2/2004 |
| JP | 2006-238522 | 9/2006 |
| WO | WO 00/69041 | 11/2000 |

OTHER PUBLICATIONS

Japanese Office Action mailed Nov. 18, 2011 in corresponding Japanese Patent Application No. 2008-026260 with partial English language translation.

Taiwanese Office Action mailed Feb. 7, 2012 in corresponding Taiwanese Patent Application No. 096143185 with partial English language translation of relevant part.

* cited by examiner

*Primary Examiner* — Tulsidas C Patel
*Assistant Examiner* — Marina Fishman
(74) *Attorney, Agent, or Firm* — Brundidge & Stanger, P.C.

(57) ABSTRACT

A multi circuit type vacuum switchgear with improved ground isolation reliability. The multi circuit type vacuum switchgear has plural main circuit switches in a chamber. The respective main circuit switches, each having a fixed electrode and a movable electrode open/close to the fixed electrode, are respectively accommodated in a non-earthed type vacuum chamber. The respective movable electrodes are connected with flexible conductors. Operating rods are introduced into the non-earthed type vacuum chamber and respectively connected to the respective movable electrodes via insulators. The vacuum switchgear has a molded part having a first insulating member to insulate the main circuit switches and a second insulating member, integrally formed with the first insulating member, to insulate the movable electrode side and the movable operating rod side. The molded part is provided on the periphery of the vacuum chamber.

8 Claims, 12 Drawing Sheets

SWITCHGEAR HAVING MAIN CIRCUIT SWITCHES DISPOSED IN SEPARATE VACUUM CHAMBERS

CLAIM OF PRIORITY

The present application claims priority from Japanese application serial No. 2007-033006, filed on Feb. 14, 2007, the content of which is hereby incorporated by reference into this application.

BACKGROUND OF THE INVENTION

1. Field of the Invention

The present invention relates to a vacuum switchgear, and more particularly, to a multi circuit type vacuum switchgear having plural main circuit switches in a non-earthed vacuum chamber or chambers.

2. Description of Related Art

A multi circuit type vacuum switchgear is used in, e.g., an electric distribution system for electrical distribution to the demanding side. This type of vacuum switch gear has plural main circuit switches in a non-earthed vacuum chamber or chambers.

Patent Document 1 discloses a vacuum switchgear comprising a mold portion in which a conductor connected with a fixed electrode side of a vacuum switch is molded with resin, and a vacuum chamber which encases the switch having the fixed electrode and a movable electrode that can connect with and separate from the fixed electrode.

Patent Document 2 discloses a switchgear comprising a vacuum chamber, which encases a switch or plural switches for connecting with and separating from fixed electrodes and movable electrodes which connect with different outer conductors and which is molded and protruded out of an insulator. Plural terminals for connecting the fixed electrodes and the movable electrodes with the outer conductors project from the mold portion.

Patent Document 3 discloses a vacuum isolated switchgear comprising a vacuum chamber and a necessary number of switches encased in the vacuum chamber, in which the vacuum chamber is formed of metal materials and is covered with mold of insulating materials.

Patent Document 4 discloses a switchgear whose main circuit switches each having fixed side electrode and movable side electrode are encased in a vacuum chamber and the corresponding main circuit conductors thereof are installed through a wall of the vacuum chamber.

Patent Document 1: Japanese Patent Laid-open No. 2006-238522

Patent Document 2: Japanese Patent Laid-open No. 2000-306474

Patent Document 3: Japanese Patent Laid-open No. 2001-126595

Patent Document 4: Japanese Patent Laid-open No. 2001-135207

The above-described multi circuit type vacuum switchgear has a function for connection change in accordance with change of power load capacity on the power demanding side. If the withstand voltage performance of the vacuum switchgear becomes low, the devices on the downstream side are much influenced.

SUMMARY OF THE INVENTION

Accordingly, improvement in the reliability of the vacuum switchgear is required, and further, downsizing and price reduction of the vacuum switchgear are required. Particularly, in recent years, the reliability of ground isolation is strongly required.

The present invention was made in view of the above-described situation, and provides a multi circuit type vacuum switchgear with improved reliability of the ground isolation.

The present invention provides a vacuum switchgear comprising; a plurality of main circuit switches, wherein each of movable electrodes of the main circuit switches is connected to an air insulated rod, which is connectable to an operating rod, and wherein each of fixed electrodes of the main circuit switches is connected to a bushing conductor extending from the vacuum chamber, a plurality of earthing switches a fixed electrode of which is electrically connected to a fixed electrode of the main circuit switches, a non-earthed vacuum chamber accommodating the main circuit switches, an earthed insulating mold casing that encloses the vacuum chamber, air insulated rod and bushing conductor, and a lid that air-tightly closes the top portion of the mold casing.

DETAILED DESCRIPTION OF THE PREFERRED EMBODIMENTS

Figure 1:
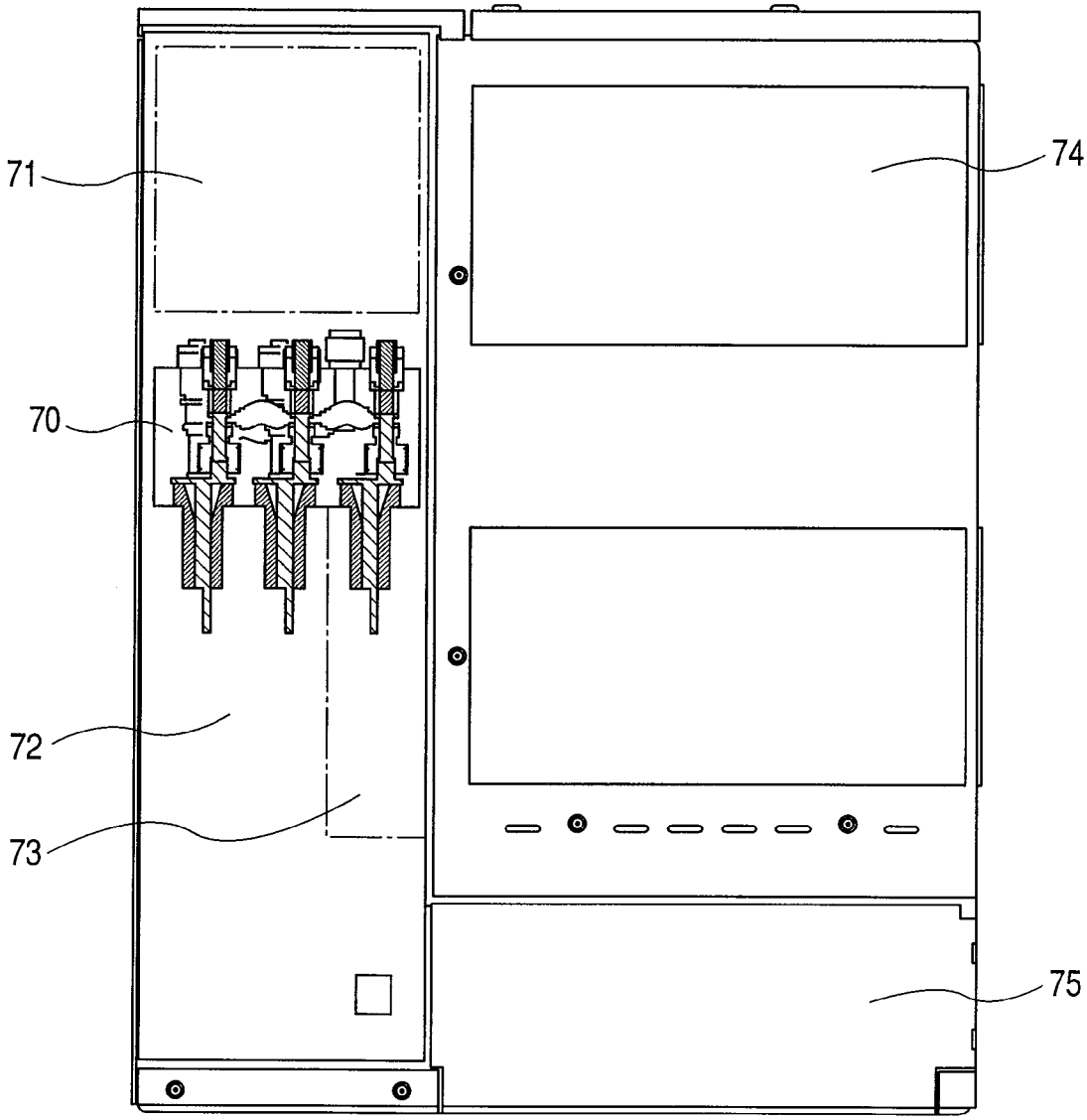
FIG. 1 is a front view showing an example of the entire structure of a switching apparatus employing the vacuum switchgear according to the present invention.

There are exemplified several aspects of the present invention, such as:

The vacuum switchgear, wherein the vacuum switchgear comprises the plurality of main circuit switches accommodated in a single non-earthed vacuum chamber accommodating the main circuit switches, the adjoining movable electrodes of the adjoining main circuit switches being electrically connected in the non-earthed vacuum switches.

The vacuum switchgear, wherein the vacuum switchgear comprises the plurality of main circuit switches each being accommodated in a single non-earthed vacuum chamber, the adjoining movable electrodes of the main circuit switches being electrically connected to each other outside the non-earthed vacuum chamber.

A vacuum switchgear comprising; a single non-earthed vacuum chamber accommodating a plurality of main circuit switches each of the switches comprising movable electrode and fixed electrode, the adjoining movable electrodes being electrically connected to each other in the vacuum chamber, a plurality of bushing conductors electrically connected to the corresponding fixed electrodes of the main circuit switches and extended from the non-earthed vacuum chamber, earthing switches each being accommodated in a vacuum chamber separated from the non-earthed vacuum chamber or in an air chamber at positions corresponding to the main circuit switches, air-insulated rods connected to the corresponding movable electrodes of the main circuit switches for transferring movement of an operating mechanism, an earthed resin mold casing that air-tightly surrounds the non-earthed vacuum chamber, the bushing conductors and the vacuum chambers or air chambers of the earthing switches, and a lid air-tightly closing the top of the mold casing.

A vacuum switchgear according to one aspect of the present invention comprises a plurality of main circuit switches disposed in a single non-earthed vacuum chamber, each of the main circuit switches comprising fixed electrode and movable electrode in a non-earthed vacuum chamber. The respective movable electrodes of adjoining main circuit switches are electrically connected with flexible conductors. Operation rods on the movable electrode side are connected to insulating rods in the non-earthed vacuum chamber. The movable side operation rods are interconnected with the respective movable electrodes through insulators or insulating rods. A mold casing around the vacuum chamber, air insulating rods and bushing conductors comprises a first insulating mold part for insulating the bushing conductors connecting to the main circuit switches, a second insulating mold part integrated with the first mold part for insulating the movable electrodes side and the operation rods on the movable electrode side.

Further, a vacuum switchgear according to another aspect of the present invention comprises a plurality of main circuit switches in a single vacuum chamber, accommodating the main circuit switches each comprising a fixed electrode and a movable electrode in the vacuum chamber. The movable electrodes are electrically connected each other with flexible conductors. The operation rods on the movable electrode side are connected with the respective movable electrodes. A mold casing including a first insulating mold part for insulating a plurality of bushing conductors. The main circuit switches and the fixed electrodes, and a second insulating mold part is integrated with the first mold part for insulating the flexible conductors and the operation rods.

According to the present invention, a vacuum switchgear becomes inexpensive and downsized, and further, the performance of ground isolation in the multi circuit type vacuum switchgear is improved; thus the reliability can be further improved.

Figure 2:
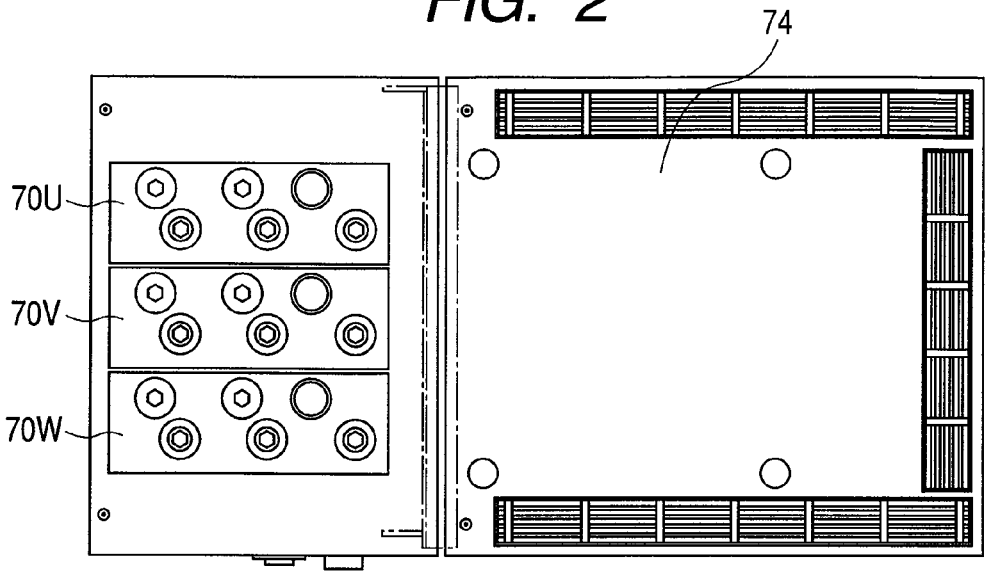
FIG. 2 is a top view showing the example of the entire structure of the switching apparatus employing the vacuum switchgear according to the present invention shown in FIG. 1.

FIGS. 1 and 2 show an example of the entire structure of a switching apparatus that employs the vacuum switchgear according to the present invention to which a transformer 74 is connected. FIG. 1 is a front view and FIG. 2, a top view of FIG. 1. In FIG. 1, reference numeral 70 denotes a vacuum switchgear according to the present invention; 71, an operating mechanism section; 72, a cable chamber; 73, a fuse chamber; 74, a transformer chamber; and 75, a low voltage chamber. In FIG. 2, reference numerals 70U to 70W denote respective vacuum switch modules connected with a three-phase power supply.

Figure 3:
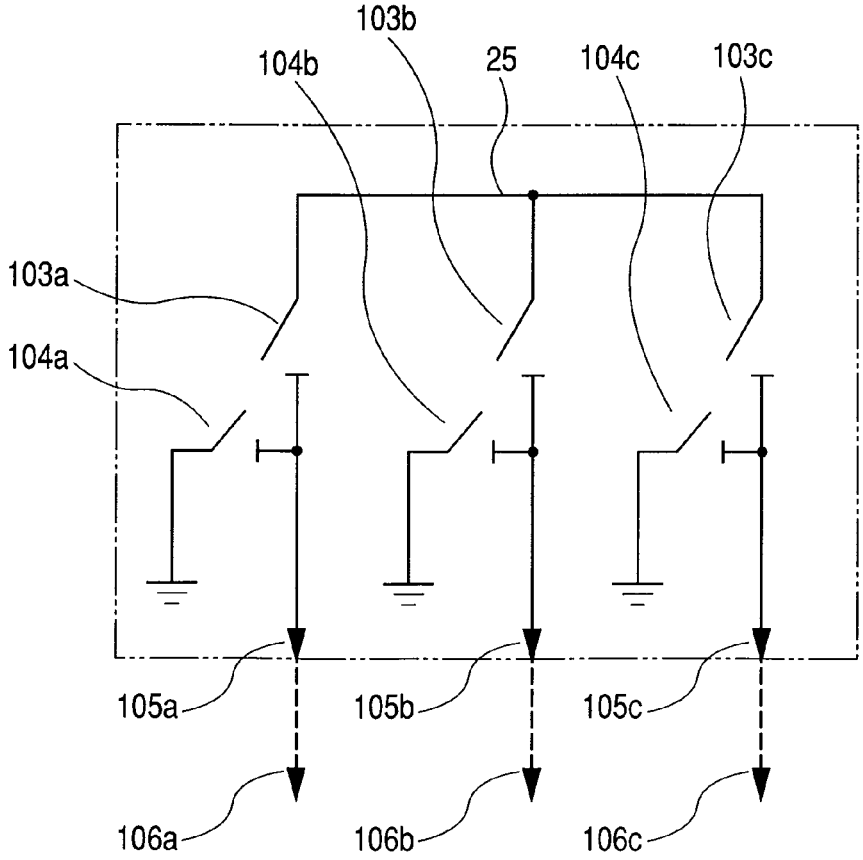
FIG. 3 is a connecting diagram showing an example of the switching apparatus employing the vacuum switchgear according to the present invention.

FIG. 3 is a connecting diagram showing an example of the vacuum switchgear according to the present invention. In this example, an example of a 3-circuit switching is shown. In FIG. 3, numerals 103*a* to 103*c* denote main circuit switches; 104*a* to 104*c*, earthing device; 105*a* to 105*c*, bushings; and 106*a* to 106*c*, cables.

Figure 4:
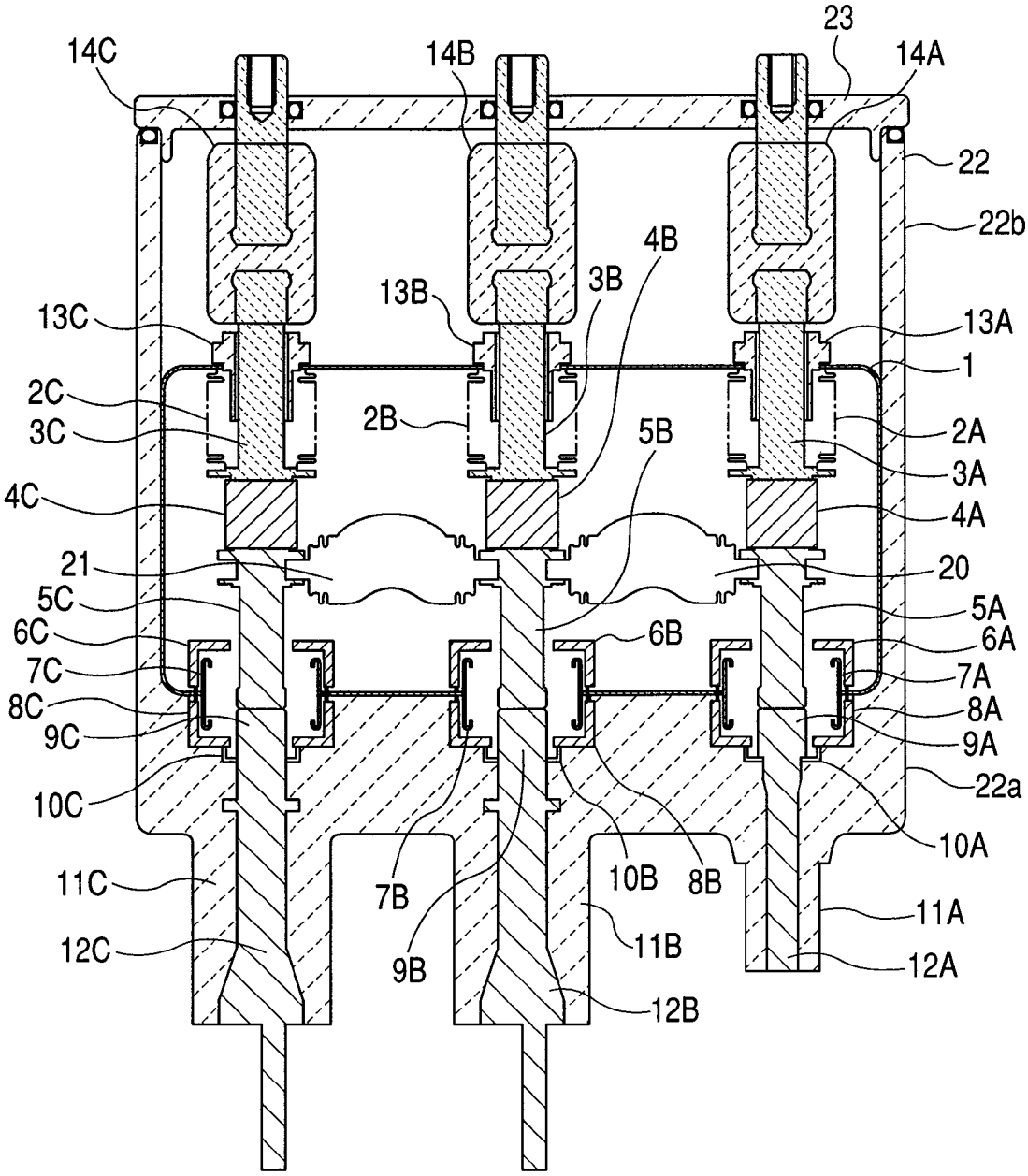
FIG. 4 is a longitudinal front, cross-sectional view showing an embodiment of the vacuum switchgear according to the present invention.
Figure 5:
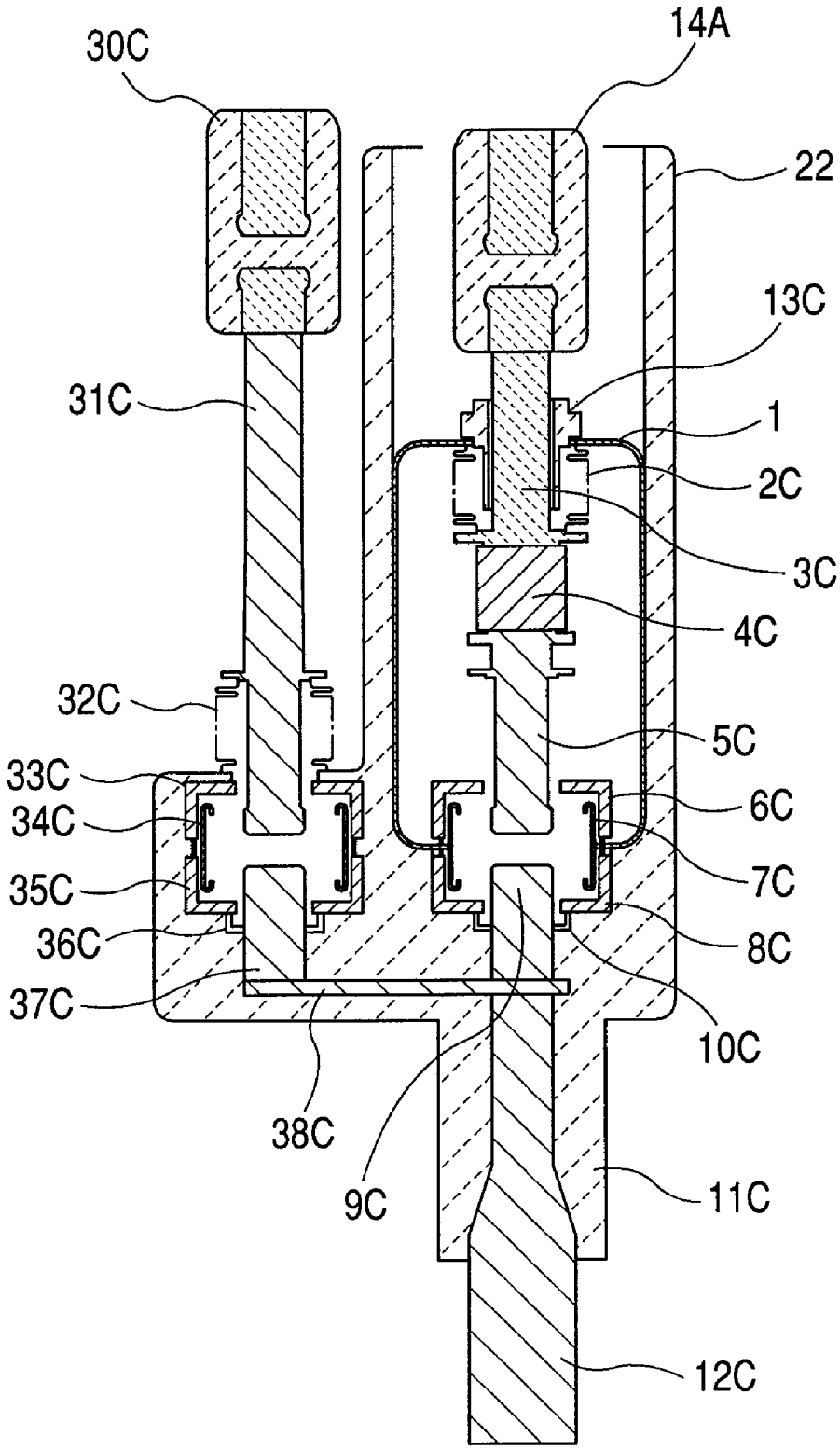
FIG. 5 is a longitudinal side, cross-sectional view showing the embodiment of the vacuum switchgear according to the present invention in FIG. 4.

FIGS. 4 and 5 show an embodiment of the vacuum switchgear according to the present invention. FIG. 4 is a longitudinal front view; and FIG. 5, a longitudinal side view of FIG. 4. In these figures, this embodiment has three main circuit switches (current interrupters) with fixed electrodes 9A to 9C and movable electrodes 5A to 5C respectively open/close to the fixed electrodes 9A to 9C. These main circuit switches are accommodated in a non-earthed type vacuum chamber 1. An inside of the non-earthed type vacuum chamber 1 is kept a low-pressure condition.

The contacts of the fixed electrodes 9A to 9C and of the movable electrodes 5A to 5C are formed from a material dispersing a powder of chromium (Cr) i.e. a fireproof metal in a matrix of an alloy of copper (Cu) i.e. a high conductive metal, and a member selected from tellurium (Te), bismuth (Bi) or tin (Sn) of a low melting point metal. Another parts of the fixed electrodes 9A to 9C and the movable electrodes 5A to 5C are electrode rods and formed from oxygen free copper (pure copper). The contacts are connected to the oxygen free copper with brazing.

Arc shields 7A to 7C are respectively provided in portions corresponding to the respective main circuit switches. Upper ceramics cylinders 6A to 6C and lower ceramics cylinders 8A to 8C are provided on the peripheries of these arc shields 7A to 7C. The upper ceramics cylinders 6A to 6C have holes to allow insertion of the movable electrodes 5A to 5C in their upper parts. The lower ceramics cylinders 8A to 8C have end plates (lids) to allow insertion of the fixed electrodes 9A to 9C in their lower parts. Fixed side seal rings 10A to 10C are respectively provided in the insertion portions of the lower ceramics cylinders 8A to 8C for insertion of the fixed electrodes 9A to 9C.

Bushing conductors 12A to 12C are integrally coupled to the fixed electrodes 9A to 9C. The movable electrodes 5A to 5C are electrically interconnected with flexible conductors 20 and 21 covered with bellows on the surface side. One ends of movable operating rods 3A to 3C are respectively coupled via insulators 4A to 4C to the respective movable electrodes 5A to 5C. The movable operating rods 3A to 3C are guided out of the vacuum chamber 1 through guides 13A to 13C provided on an upper surface of the vacuum chamber 1. The ends of the movable operating rods 3A to 3C opposite to the sides connected to the insulators 4A to 4C are respectively coupled to insulated operating rods in the air 14A to 14C. In the vacuum chamber 1 in which the guides 13A to 13C are provided, bellows 2A to 2C, with one ends connected to the vacuum chamber 1 and the other ends connected to the movable operating rods 3A to 3C, are respectively provided such that the movable operating rods 3A to 3C can move vertically. The bellows 2A to 2C hold airtight sealing in the vacuum chamber 1.

The insulated operating rods in the air 14A to 14C are called air-insulated rods. The air-insulated rods are connected for transferring a movement of the operating mechanism to the corresponding movable electrodes of the main circuit switches.

Earthing switches are connected to the fixed electrodes 9A to 9C of the respective main circuit switches. An example where the earthing switch is connected to the fixed electrode 9C of the switch will be described using FIG. 5.

In FIG. 5, as the elements having the same reference numerals as those in FIG. 4 are the same elements, the detailed explanations of the elements will be omitted. The earthing switch has an earthing switch fixed electrode 37C and an earthing switch movable electrode 31C. An air insulated operating rod 30C for earthing switch is coupled to the earthing switch movable electrode 31C. The earthing switch fixed electrode 37C is connected via a conductor 38C to the fixed electrode 9C of the switch. An earthing switch arc shield 34C is provided between opposed portions of the earthing switch fixed electrode 37C and the earthing switch movable electrode 31C.

An earthing switch upper ceramics cylinder 33C and an earthing switch lower ceramics cylinder 35C are respectively provided on the periphery of the earthing switch arc shield 34C. The earthing switch upper ceramic cylinder 33C has a hole to allow insertion of the earthing switch movable electrode 31C in its upper part. An earthing switch bellows 32C is provided between the end plate of the earthing switch upper ceramic cylinder 33C and the earthing switch movable electrode 31C.

The earthing switch lower ceramic cylinder 35C has an seal ring 36C to allow insertion of the earthing switch fixed electrode 37C in its lower part. An earthing switch fixed side seal ring 36C is provided in the insertion portion of the earthing switch lower ceramic cylinder 35C for insertion of the earthing switch fixed electrode 37C.

In the present embodiment, a molded part 22 is formed on the periphery of the non-earthed type vacuum chamber 1. As shown in FIG. 4, the molded part 22 has a first insulating member 22*a* to insulate the side of the fixed electrodes 9A to 9C of the switch and the bushing conductors 12A to 12C on the fixed electrode side, and a second insulating member 22*b*, integrally formed with the first insulating member 22*a*, to insulate the side of the movable electrodes 5A to 5C and the side of the movable operating rods 3A to 3C.

The non-earthed type vacuum chamber 1, the bushing conductors 12A to 12C and a vacuum chamber for earthing switches are molded integratedly and airtightly, and the molded part 22 is formed. A molded cover 23, that is to say, a lid is installed airtightly on an end of the second insulating member 22*b* which is a part of this molded part 22. Dry air is enclosed in a space distinguished by the molded part 22 and the molded cover 23. A conductive paste or a conductive paint etc. is coated on the outside of the epoxy resin mold casing including the molded part 22 to earth the casing. That is to say, the outside of the molded part 22 can be earthed through the conductive coating. This molded part 22 is called an earthed mold casing.

The reason why the non-earthed type vacuum chamber 1 and the vacuum chamber for earthing switches are different vacuum chambers is because the latter vacuum chamber is not influenced when a vacuum degree in the former vacuum chamber deteriorated.

More particularly, the first insulating member 22*a* is an epoxy resin mold covering the periphery of the vacuum chamber 1 corresponding to the fixed electrodes 9A to 9C and the peripheral surfaces of the busing conductors 12A to 12C on the fixed electrode side. The second insulating member 22*b* is an epoxy resin mold, integrally formed with the epoxy rein mold as the first insulating member 22*a*, covering the periphery of the vacuum chamber 1 corresponding to the side of the movable electrodes 5A to 5C and the side of the movable operating rods 3A to 3C. Further, as shown in FIG. 5, the earthing switch is provided in another section of that of the non-earthed type vacuum chamber, and integrally molded with the non-earthed type vacuum chamber 1 with the first insulating member 22*a*. Further, the bushing conductors 12A to 12C are integrally covered with the epoxy resin mold as the first insulating member 22*a*, thereby forming insulated bushings 11A to 11C.

As described above, in the present embodiment, the three main circuit switches, the flexible conductors 20 and 21, and a part of the movable electrode side of the movable operating rods 3A to 3C are accommodated in one non-earthed type vacuum chamber 1, and insulated with the first insulating member 22*a* covering the peripheral surface of the non-earthed type vacuum chamber 1 and the peripheral surfaces of the bushing conductors 12A to 12C on the fixed electrode side, and the second insulating member 22*b*. The movable operating rods 3A to 3C are guided out of the vacuum chamber 1 via the bellows 2A to 2C, and air-insulated.

In FIG. 5, electric contacts of the movable electrode 5C and the fixed electrode 9C, that is, a movable contact and a fixed contact of the main circuit switch are encased in a switching zone formed in an area of the molded part 22. The movable contact and the fixed contact are parts of near the electric contacts of the movable electrode 5C and the fixed electrode 9C, and are formed from a copper ally brazed on ends of electrode rods formed from oxygen free copper. The construction of this copper ally is described hereinbefore.

The switching zone is formed in a concave of the first insulating member 22*a* formed in a deepest area of a part inside the molded part 22 in which non-earthed type vacuum chamber 1 is installed. This switching zone includes an upper ceramic cylinder 6C, a lower ceramic cylinder 8C and a fixed side seal ring 10C. Further, an arc shield 7C is encased in the switching zone. In this embodiment, the switching zone is installed in the concave of the first insulating member 22*a*, and the lower ceramic cylinder 8C and the fixed side seal ring 10C are covered by the molded part 22. But the switching zone is not necessarily installed in the concave of the first insulating member 22*a* and the lower ceramic cylinder 8C and the fixed side seal ring 10C are not necessarily covered by the molded part 22. That is, the lower ceramics cylinder 8C may crop out in the non-earthed type vacuum chamber 1, or the lower ceramic cylinder 8C and the fixed side seal ring 10C may crop out in the non-earthed type vacuum chamber 1.

As shown in this figure, because a hole having a diameter a little bit larger than a diameter of the movable electrode 5C is provided on a plane portion of the upper ceramic cylinder 6C, dispersion of metal vapor into another area of the vacuum chamber 1, generated by electric discharge etc. when the movable electrode 5C and the fixed electrode 9C contact or separate each other, can be suppressed.

Further, contacts of an earthing switch movable electrode 31C and an earthing switch fixed electrode 37C, that is, the movable contact and the fixed contact are encased in the switching zone covered with the molded part 22. This switching zone includes an upper ceramic cylinder 33C, a lower ceramic cylinder 35C and a fixed side seal ring 36C. Moreover, an arc shield 34C is encased in the switching zone.

An area surrounded with a bellows 32C, the upper ceramic cylinder 33C, the lower ceramic cylinder 35C and a fixed side seal ring 36C, etc. are kept vacuum (a low pressure condition). This is called a vacuum chamber for the earthing switch. The earthing switch has electric contacts encased in the vacuum chamber for the earthing switch corresponding to the main circuit switch.

Further, although the molded cover 23 is not shown in FIG. 5, the molded cover 23 may be installed as same as in FIG. 4.

According to the above-described embodiment of the vacuum switchgear of the present invention, the three main circuit switches, the flexible conductors 20 and 21 and a part of the movable electrode side of the movable operating rods 3A to 3C are accommodated in one non-earthed type vacuum chamber 1, and an insulating member of epoxy resin mold is formed on the peripheral surface of the non-earthed type vacuum chamber 1 including the peripheral surfaces of the bushing conductors 12A to 12C. Accordingly, a multicircuit type vacuum switch gear with further improved ground isolation reliability can be provided.

Further, in this embodiment, as the vacuum chamber 1 is anon-earthed chamber, the isolation performance is stabilized, and the structure is simplified. Further, as the arc shields 7A to 7C in the respective main circuit switches are previously installed in the vacuum chamber 1, the assembly work is improved. In addition, as the respective main circuit switches can be individually operated in a practical operation, no branch current to the arc shields 7A to 7C occurs when electric current is cut off or is thrown into.

Figure 6:
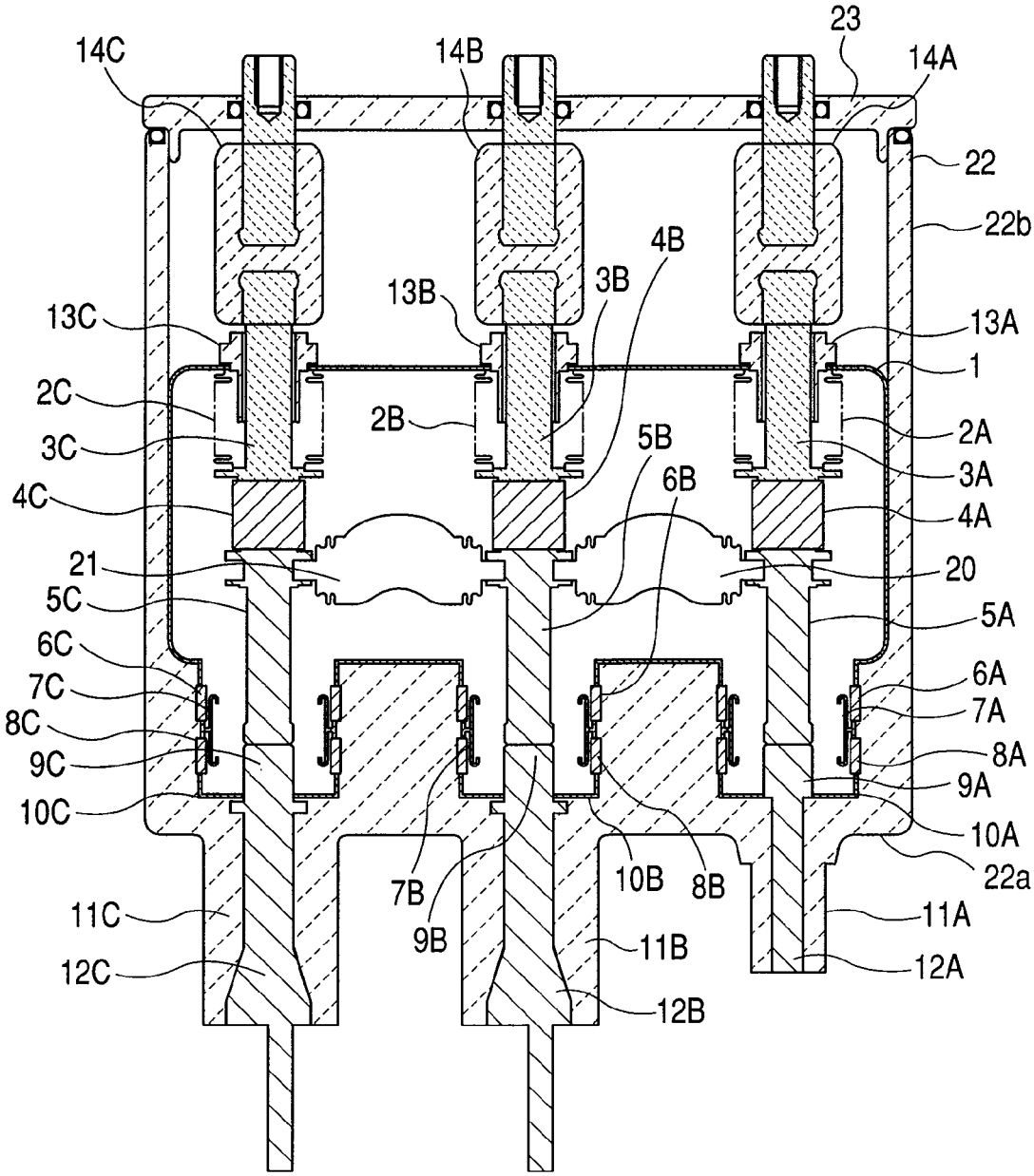
FIG. 6 is a longitudinal front, cross-sectional view showing another embodiment of the vacuum switchgear according to the present invention.

FIG. 6 is a longitudinal front view showing another embodiment of the vacuum switchgear according to the present invention. In FIG. 6, as the elements having the same reference numerals as those in FIGS. 4 and 5 are the same elements, the detailed explanations of the elements will be omitted.

In this embodiment, in the main circuit switches, the upper ceramics cylinders 6A to 6C and the lower ceramics cylinders 8A to 8C have a tubular cylindrical shape.

In this figure, different from the cases of FIGS. 4 to 5, the upper ceramic cylinders 6C has no flat face, constituted only by a cylindrical sidepiece. Because the switching zone is encased in the concave of the first insulating member 22*a* formed in the deepest area of the part inside the molded part 22 in which non-earthed type vacuum chamber 1 is installed, dispersion of metal vapor, generated by electric discharge etc. into another area of the vacuum chamber 1 can be suppressed.

Further, the same as in FIG. 4, the molded cover 23, that is, the lid is provided airtightly on the end of the second insulating member 22*b* which is the part of the molded part 22. Dry air is enclosed in a space formed of the molded part 22 and the molded cover 23. Further, a conductive paste or a conductive paint etc. is coated on the epoxy resin mold including the molded part 22 is to unify electric potential of the casing with that of the outside.

According to the present embodiment, as in the case of the above-described embodiments, the occurrence of grounding due to particles generated in the vacuum chamber 1 can be suppressed, and a multi circuit type vacuum switchgear with further improved reliability can be provided. Further, in the main circuit switches, the upper ceramics cylinders 6A to 6C and the lower ceramics cylinders 8A to 8C have a tubular cylindrical shape without end plate. As the structure of the upper ceramics cylinders 6A to 6C and the lower ceramics cylinders 8A to 8C is simplified, the costs can be reduced.

Figure 7:
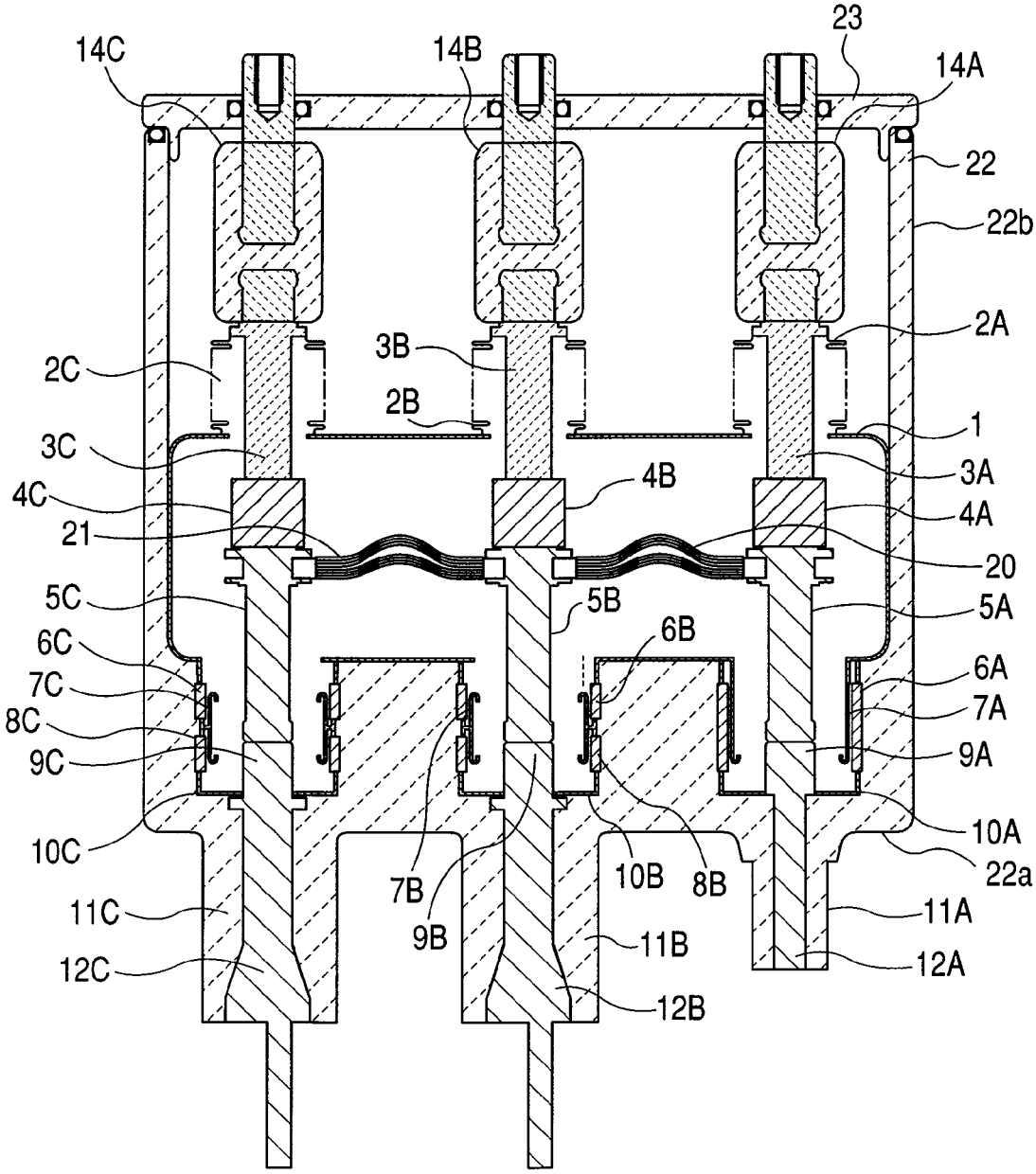
FIG. 7 is a longitudinal front, cross-sectional view showing another embodiment of the vacuum switchgear according to the present invention.

FIG. 7 is a longitudinal front view showing another embodiment of the vacuum switchgear according to the present invention. In FIG. 7, as the elements having the same reference numerals as those in FIGS. 4 to 6 are the same elements, the detailed explanations of the elements will be omitted.

In this embodiment, the bellows covering the flexible conductors 20 and 21 in the embodiment shown in FIG. 6 are removed and the flexible conductors 20 and 21 are used as simple bodies, thereby the structure of the conductors is simplified. Further, the bellows 2A to 2C for airtight sealing in the guides 13A to 13C in the vacuum chamber 1 shown in FIG. 6 are provided on the upper outside of the vacuum chamber 1. Further, to reduce the vacuum volume in the vacuum chamber 1, the lower parts of the bellows 2A to 2C are airtightly attached to the outside upper surface of the vacuum chamber 1, and the upper part of the bellows are airtightly attached to the movable operating rods 3*a* to 3C guided out of the vacuum chamber 1. In this case, the guides (not shown) are provided in touch with the insulated operating rods in the air 14A to 14C, thereby the vertical moving direction of the movable side can be regulated. Further, as shown in the switch on the right side in FIG. 7, when the arc shield 7A is integrated with the vacuum chamber 1, the number of parts can be reduced.

According to the present embodiment, as in the case of the above-described embodiments, a multi circuit type vacuum switchgear with further improved ground isolation reliability can be provided. Further, as the vacuum volume in the vacuum chamber 1 and the number of parts can be reduced, the costs can be further reduced.

Figure 8:
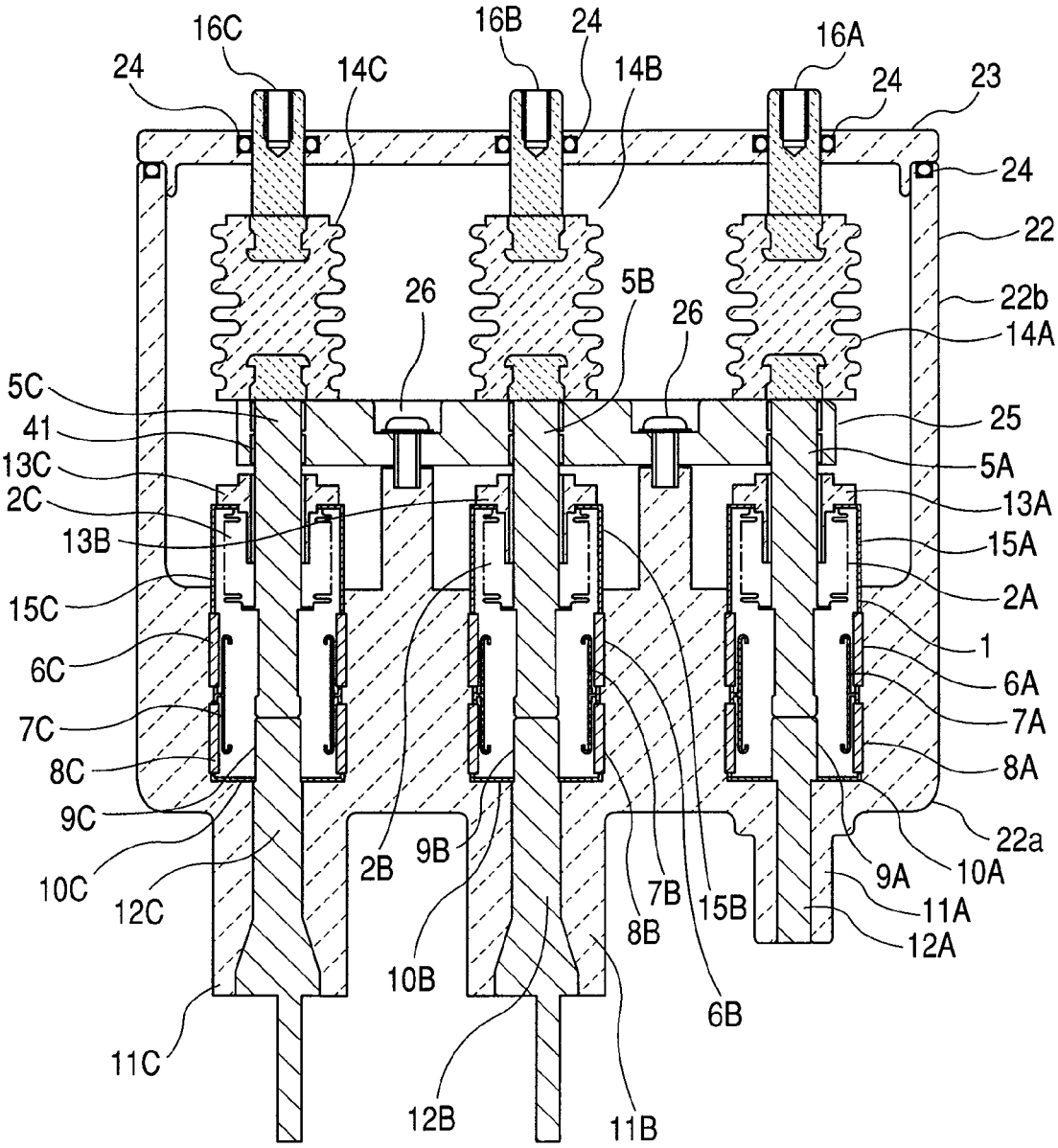
FIG. 8 is a longitudinal front, cross-sectional view showing still another embodiment of the vacuum switchgear according to the present invention.
Figure 9:
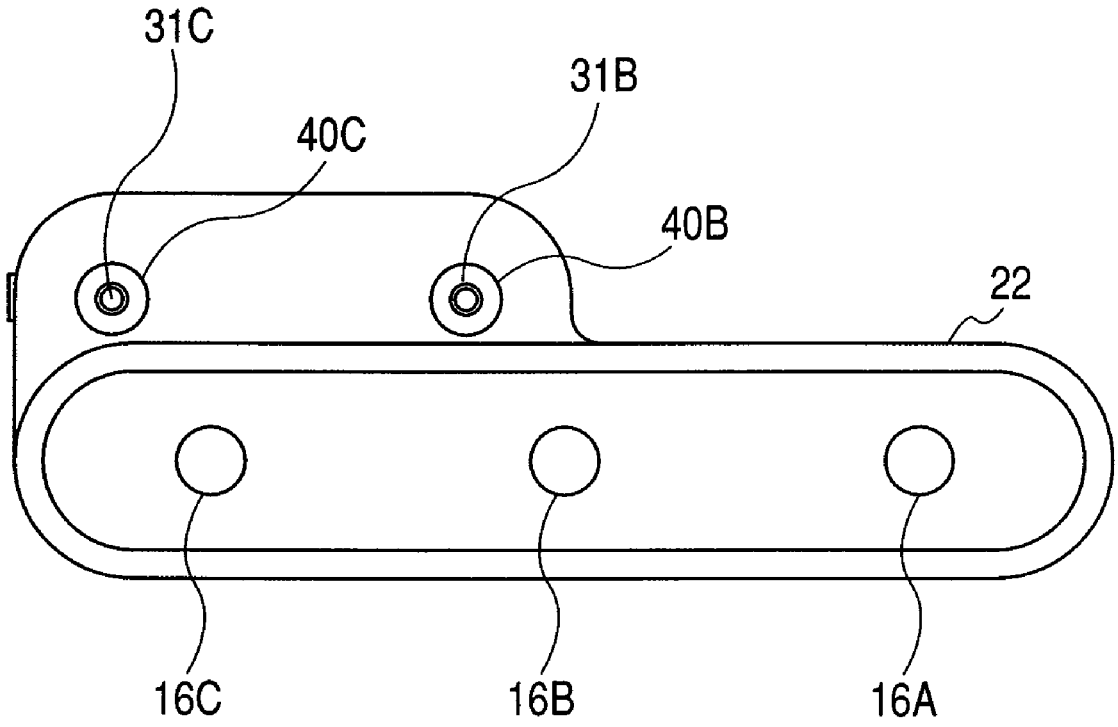
FIG. 9 is a top view of the vacuum switchgear according to the present invention shown in FIG. 8.
Figure 10:
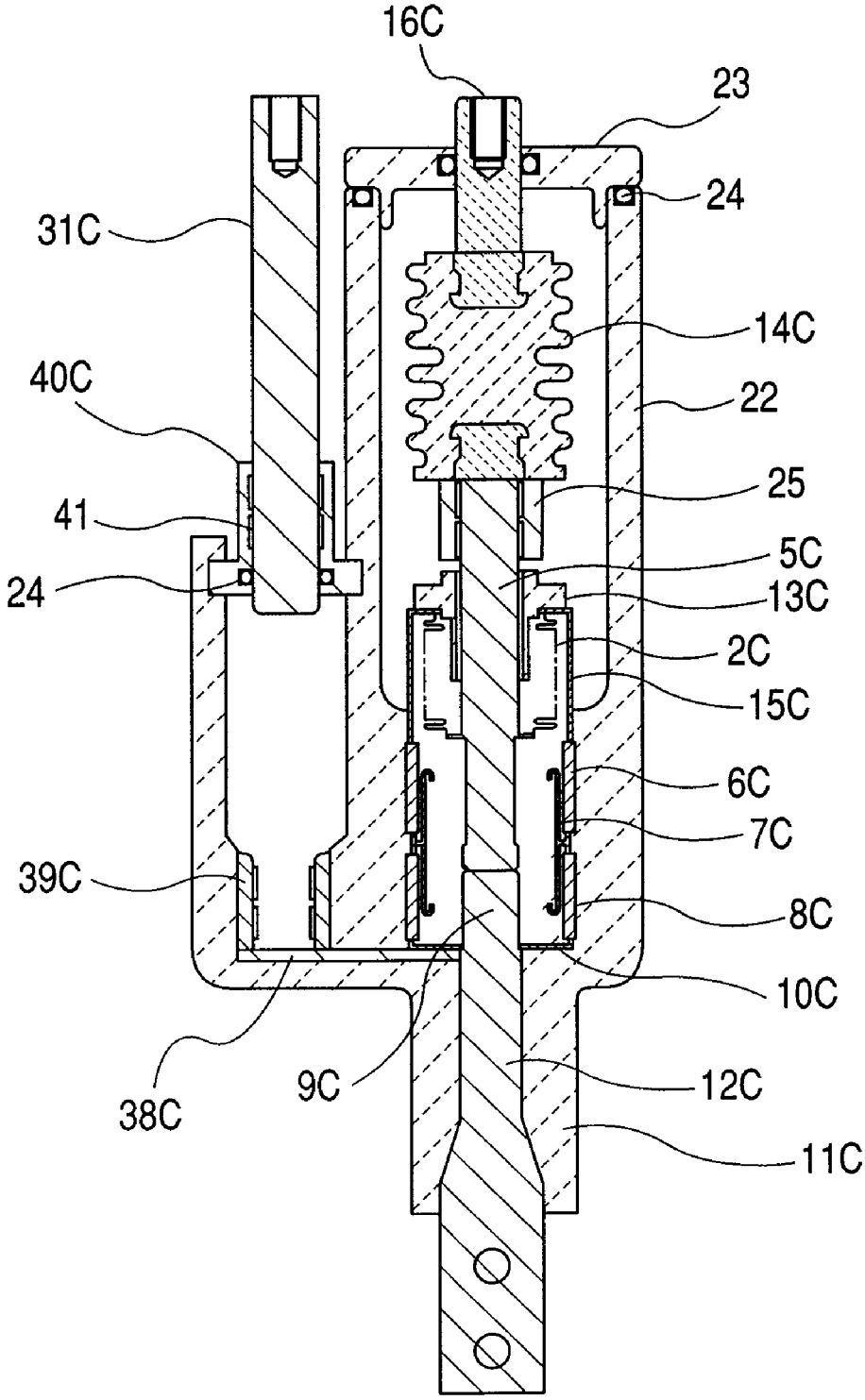
FIG. 10 is a longitudinal side, cross-sectional view showing the embodiment of the vacuum switchgear according to the present invention shown in FIG. 8.
Figure 11:
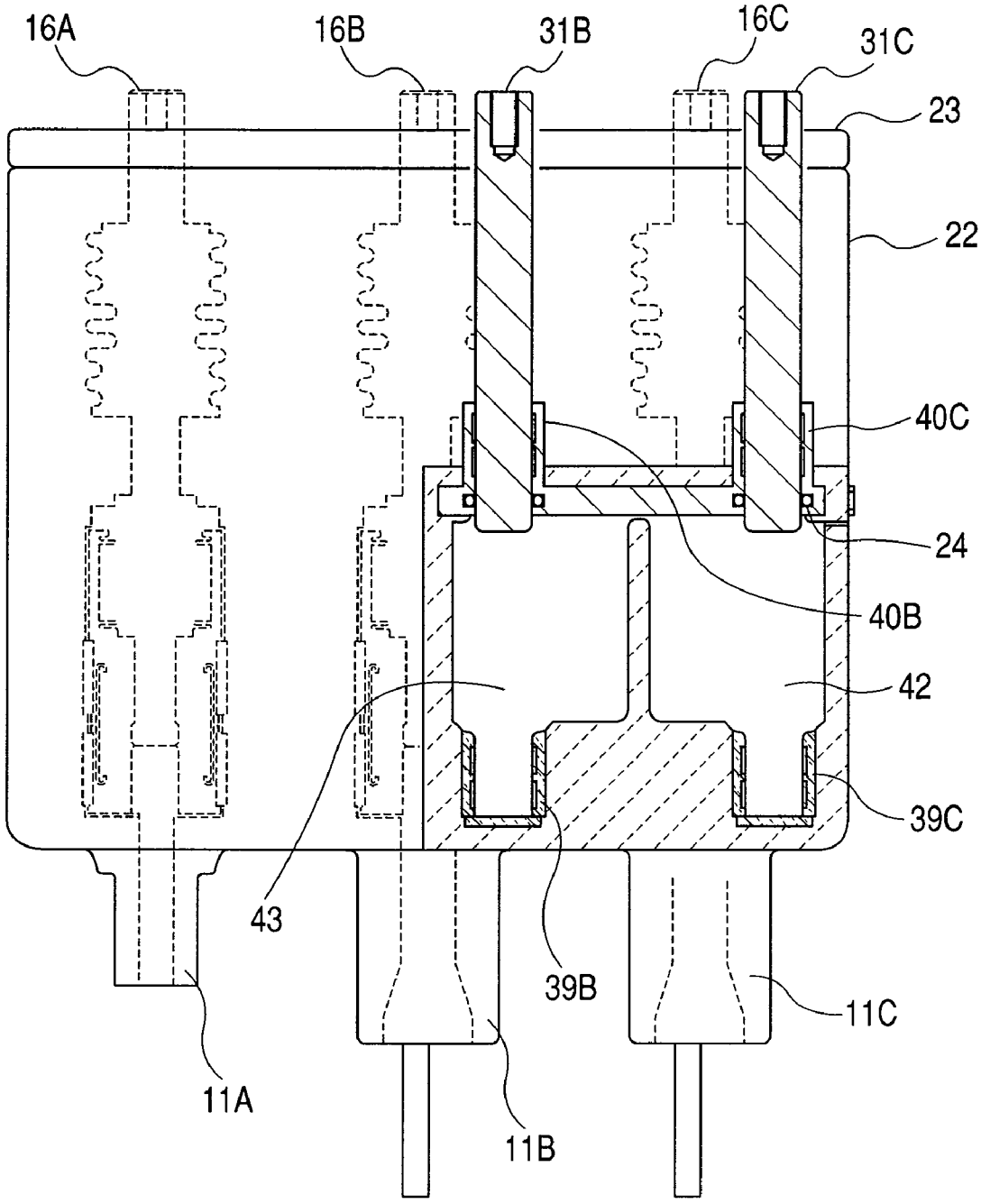
FIG. 11 is a longitudinal back, partially cross-sectional view showing the embodiment of the vacuum switchgear according to the present invention shown in FIG. 8.

FIGS. 8 to 11 show another embodiment of the vacuum switchgear of the present invention. FIG. 8 is a longitudinal front view; FIG. 9 is a plan view of FIG. 8; FIG. 10 is a longitudinal side view of FIG. 8; and FIG. 11 is a longitudinal back view of FIG. 8. In these FIGS. 8 to 11, in this example, the vacuum switchgear has three main circuit switches (current interrupters) including the fixed electrodes 9A to 9C and the movable electrodes 5A to 5C open/close to the fixed electrodes 9A to 9C. The bushing conductors 12A to 12C are respectively integrally coupled to the fixed electrodes 9A to 9C.

The above-described respective main circuit switches are respectively accommodated in the vacuum chamber 1. The respective vacuum chambers 1 have the upper ceramics cylinders 6A to 6C, the lower ceramics cylinders 8A to 8C, movable side seal rings 15A to 15C provided on the upper side of the upper ceramics cylinders 6A to 6C, having outlet portions for the movable electrodes 5A to 5C, the fixed side seal rings 10A to 10C provided on the lower side of the lower ceramics cylinders 8A to 8C, and the bellows 2A to 2C provided inside the movable side seal rings 15A to 15C, with one ends provided on the movable electrodes 5A to 5C inside the vacuum chamber 1 and the other ends connected airtightly with the movable side seal rings 15A to 15C. That is to say, each of the non-earthed type vacuum chambers accommodates a pair of fixed electrode and movable electrode of the main circuit switches.

The bellows 2A to 2C respectively connected to the movable electrodes 5A to 5C enable vertical motion of the movable electrodes 5A to 5C, and holds airtight sealing in the vacuum chamber 1. In the respective vacuum chambers 1, the arc shields 7A to 7C are provided in portions corresponding to the respective main circuit switches. The guides 13A to 13C to guide the movable electrodes 5A to 5C guided out of the vacuum chamber 1 are provided on the upper surfaces of the movable side seal rings 15A to 15C. The insulated operating rods in the air 14A to 14C are provided at the ends of the movable electrodes 5A to 5C guided out of the vacuum chamber 1. The operating rods 16A to 16C are respectively coupled to these insulated operating rods in the air 14A to 14C.

Further, the ends of the movable electrodes 5A to 5C guided out of the vacuum chamber 1 are electrically connected with a conductor 25. The connection is enabled by contact between a multi contact (collector) 41 provided in through holes in the conductor 25 for the movable electrodes 5A to 5C. The conductor 25 is fixed to the molded part 22 to be described later with a bolt 26.

As shown in FIGS. 10 and 11, earthing switches are connected to the fixed electrodes 9B and 9C in the respective main circuit switches. As shown in FIGS. 10 and 11, the earthing switches have fixed side contact bases 39B and 39C and earthing switch movable electrodes 31B and 31C open/close to the fixed side contact bases 39B and 39C. The fixed side contact bases 39B and 39C are respectively connected to the fixed electrodes 9B and 9C via a conductor 38C. The earthing switch movable electrodes 31B and 31C are guided with contact bases 40B and 40C having the multi contact (collector) 41. Further, the fixed electrode 9B of the main circuit switch is also connected, the same as the fixed electrodes 9C.

In the present embodiment, the molded part 22 is formed on the periphery of the vacuum chamber 1. As shown in FIG. 8, the molded part 22 has the first insulating member 22*a* to insulate the side of the fixed electrodes 9A to 9C of the main circuit switches and the bushing conductors 12A to 12C on the fixed electrode side, and the second insulating member 22*b*, integrally formed with the first insulating member 22*a*, to insulate the side of the movable electrodes 5A to 5C, the conductor 25, the insulated operating rods in the air 14A to 14C, and the side of the movable operating rods 16A to 16C outside the respective vacuum chambers 1.

More particularly, the first insulating member 22*a* of the molded part 22 is an epoxy resin mold covering the lower peripheries of the respective vacuum chambers 1 and the peripheral surfaces of the busing conductors 12A to 12C on the fixed electrode side. The second insulating member 22*b* is an epoxy resin mold, integrally formed with the epoxy rein mold as the first insulating member 22*a*, surrounding the side of the movable operating rods 16A to 16C via the conductor 25 and the insulated operating rods in the air 14A to 14C. An earthed layer is formed on the peripheral surface of the molded part 22.

Further, the contact base 40C and the fixed side contact base 39C in the earthing switch are integrally molded with the above-described first insulating member 22*a* of the molded part 22.

A molded cover 23 is attached to the upper part of the second insulating member 22*b* of the molded part 22 via a seal 24. The molded cover 23 has through holes for the movable operating rods 16A to 16C. The through holes are provided with seals 24.

Note that in the present embodiment, the earthing switches are respectively connected to the fixed electrodes 9B and 9C.

As described above, in the present embodiment, the respective main circuit switches are accommodated in individual vacuum chambers. These vacuum chambers are integrally molded with the first insulating member 22*a* which is an epoxy resin mold. On the side of the movable electrodes 5A to 5C, the conductor 25, the insulated operating rods in the air 14A to 14C and the movable operating rods 16A to 16C, the second insulating member 22*b* integrally formed with the epoxy resin mold as the first insulating member 22*a* is provided so as to surround these elements. Thus the side of the movable electrodes 5A to 5C, the conductor 25 and the side of the movable operating rods 16A to 16C are air-insulated.

According to the above-described embodiment of the vacuum switchgear of the present invention, the respective main circuit switches are accommodated in the individual vacuum chambers, and these vacuum chambers are integrally molded with the first insulating member 22*a* which is an epoxy resin mold. On the side of the movable electrodes 5A to 5C, the conductor 25, the insulated operating rods in the air 14A to 14C and the movable operating rods 16A to 16C, the second insulating member 22*b* integrally formed with the epoxy resin mold as the first insulating member 22*a* is provided so as to surround these elements. Thus, as the side of the movable electrodes 5A to 5C, the conductor 25 and the side of the movable operating rods 16*a* to 16C are air-insulated, a multi circuit type vacuum switchgear with further improved ground isolation reliability can be provided.

Further, in the present embodiment as the conductor 25 having the multi contact (collector) 41 is fixed on the movable side, an electromagnetic repel force can be received by the conductor 25, thereby the electromagnetic repel force applied to movable side electrode can be reduced. Further, in comparison with the case where the plural main circuit switches are accommodated in one vacuum chamber, the vacuum chambers can be downsized. As a result, the unit costs of the parts and the production cost can be reduced, and the entire cost can be greatly reduced.

Further, in the present embodiment, as shown in FIG. 11, in the earthing switch, an earthing switch chamber 42 and an earthing switch chamber 43 may be molded so as to be closely provided to each other. In this structure, as the space in the earthing switch is reduced, the amount of mold can reduced, thus the original cost can be reduced.

Figure 12:
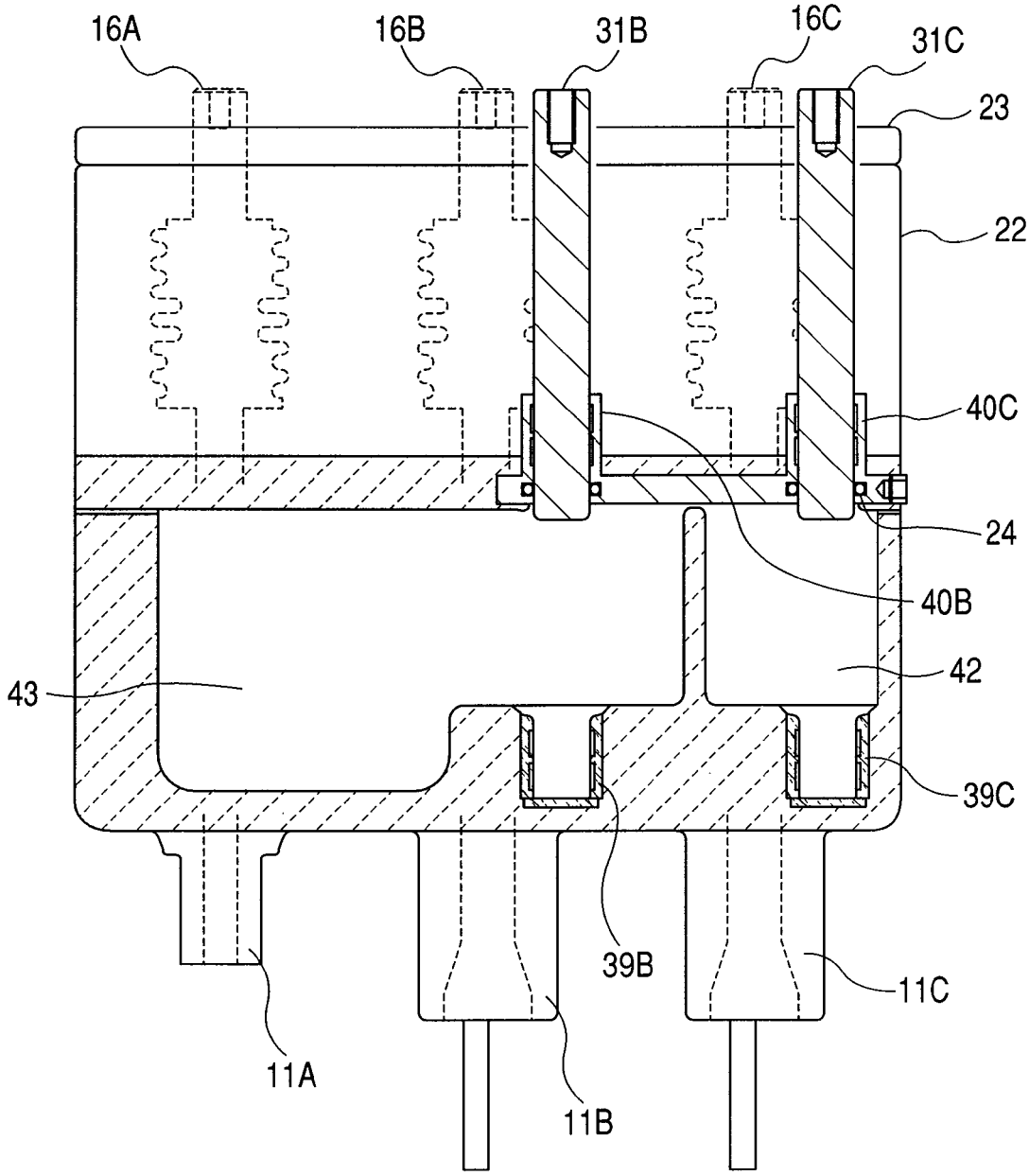
FIG. 12 is a longitudinal back, partially cross-sectional view showing another embodiment of the vacuum switchgear according to the present invention shown in FIG. 9.

FIG. 12 is a longitudinal back view showing another embodiment of the vacuum switchgear according to the present invention shown in FIGS. 8 to 11. In FIG. 12, as the elements having the same reference numerals as those in FIGS. 4 to 11 are the same elements, the detailed explanations of the elements will be omitted.

In this embodiment, the earthing switch chamber 43 in the earthing switch is wide.

According to the present embodiment, as the pressure change in the earthing switch chamber 43 which occurs upon vertical motion of the earthing switch movable electrode 31 can be suppressed, it is easy to seal with the seal 24, and the reliability can be improved.

Figure 13:
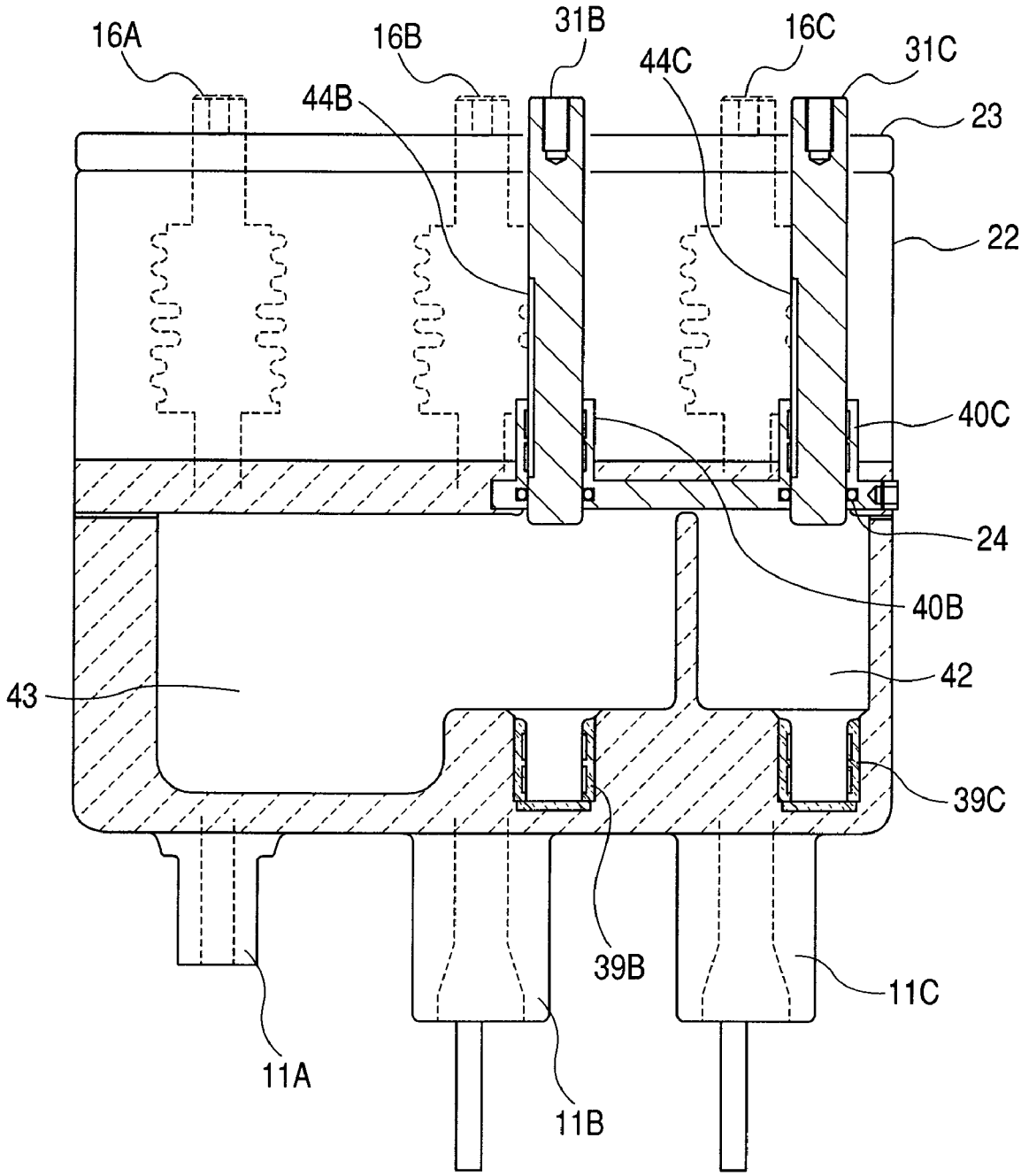
FIG. 13 is a longitudinal back, partially cross-sectional view showing another embodiment of the vacuum switchgear according to the present invention shown in FIG. 10.

FIG. 13 is a longitudinal back view showing another embodiment of the vacuum switchgear according to the present invention shown in FIGS. 8 to 11. In FIG. 13, as the elements having the same reference numerals as those in FIGS. 4 to 12 are the same elements, the detailed explanations of the elements will be omitted.

In the present embodiment, communication grooves 44B and 44C for communication between the earthing switch chambers and the ambient air side are respectively provided on the side surfaces of the earthing switch movable electrodes 31B and 31C. The communication grooves 44B and 44C prevent condensation in the earthing switch chambers by communicating the earthing switch chambers with the ambient air side, only upon interruption operation and actuation operation of the earthing switches.

Note that in the embodiment shown in FIGS. 8 to 13, the air insulated type earthing switch is shown, however, the vacuum insulated type earthing switch as shown in FIG. 5 is applicable. Further, the vacuum insulated type earthing switch in the embodiment shown in FIG. 5 may be replaced with the air insulated type earthing switch.

What is claimed is:

1. A vacuum switchgear comprising;

a plurality of main circuit switches each being disposed in a respective non-earthed vacuum chamber isolated from each other and having a respective movable electrode and fixed electrode, wherein each of the movable electrodes of the main circuit switches is connected to an air-insulated rod, which is connectable to an operating rod, wherein each of the fixed electrodes of the main circuit switches is connected to a bushing conductor extending from its respective non-earthed vacuum chamber, an earthed insulating mold casing that encloses the non-earthed vacuum chambers, air-insulated rods and bushing conductors, wherein the non-earthed vacuum chambers are enclosed in the earthed insulating mold casing, and each of the movable electrodes of the main circuit switches extended from the non-earthed vacuum chambers is electrically connected to each other in an air-filled portion of the earthed insulating mold casing, a plurality of earthing switches having respective fixed electrodes and movable electrodes, each fixed electrode being electrically connected to a corresponding fixed electrode of the main circuit switches, and a lid that air-tightly closes the air-filled portion of the earthed insulating mold casing, wherein the air-insulated rods are disposed in the air-filled portion of the earthed insulating mold casing.

2. The vacuum switchgear according to claim 1, wherein dry space formed between the non-earthed vacuum chamber and the lid is filled with dry air.

3. The vacuum switchgear according to claim 1, wherein contacts of the movable electrodes and fixed electrodes of one of the main circuit switches and earthing switches are located in switching zones formed at the bushing conductor sides of the earthed resin mold chamber.

4. The vacuum switchgear according to claim 3, wherein the switching zones each comprise an upper ceramics cylinder, a lower ceramics cylinder and a fixed side seal ring.

5. The vacuum switchgear according to claim 1, wherein the movable electrodes of the earthing switches are disposed in earthing switch chambers and provide fluid communication between the earthing switch chambers and the air-filled portion only when switching off and switching on of the earthing switches are completed.

6. The vacuum switchgear according to claim 1, wherein each of the non-earthed vacuum chambers is separated from each other by molding resin therebetween.

7. The vacuum switchgear according to claim 1, wherein the end portion of each of the movable electrodes extended from the non-earthed vacuum chamber is air-insulated in the air-filled portion.

8. The vacuum switchgear according to claim 1, wherein the movable electrodes of the earthing switches extended from the vacuum chamber is air-insulated in the air-filled portion.

* * * * *